US006696120B1

(12) United States Patent
Todt

(10) Patent No.: US 6,696,120 B1
(45) Date of Patent: Feb. 24, 2004

(54) SHRINK WRAP MATERIAL HAVING REINFORCING SCRIM AND METHOD FOR ITS MANUFACTURE

(75) Inventor: Gregory L. Todt, Union, MI (US)

(73) Assignee: Transhield Technology AS, Oslo (NO)

( * ) Notice: Subject to any disclaimer, the term of this patent is extended or adjusted under 35 U.S.C. 154(b) by 144 days.

(21) Appl. No.: 09/689,449

(22) Filed: Oct. 12, 2000

(51) Int. Cl.[7] ..... B32B 27/14; B32B 5/26

(52) U.S. Cl. ..... 428/34.9; 428/198; 442/2; 442/35; 442/36; 442/38; 442/49; 442/381; 442/387; 442/392; 442/394; 442/408; 206/497

(58) Field of Search ..... 442/2, 35, 36, 442/38, 49, 394, 408, 381, 387, 392; 428/34.9, 198; 53/442; 206/497

(56) References Cited

U.S. PATENT DOCUMENTS

| | | | | |
|---|---|---|---|---|
| 3,017,729 A | | 1/1962 | Cheeley | |
| 3,653,497 A | | 4/1972 | Hornstein | |
| 3,694,995 A | | 10/1972 | McKinney | |
| 3,809,223 A | | 5/1974 | Kendall | |
| 4,247,509 A | | 1/1981 | Talbot | |
| 4,725,473 A | | 2/1988 | Van Gompel | |
| 4,748,070 A | | 5/1988 | Beehler | |
| 4,763,783 A | | 8/1988 | Talbot | |
| 4,810,568 A | * | 3/1989 | Buyofsky et al. | 428/284 |
| 4,821,785 A | | 4/1989 | Rolan | |
| 4,878,974 A | * | 11/1989 | Kagawa | 156/85 |
| 4,891,249 A | | 1/1990 | McIntyre | |
| 4,931,355 A | * | 6/1990 | Radwanski et al. | 428/283 |
| 4,938,522 A | | 7/1990 | Herron et al. | |
| 5,029,933 A | | 7/1991 | Gillem | |
| 5,149,578 A | | 9/1992 | Wheatley et al. | |
| 5,342,469 A | | 8/1994 | Bodford | |
| 5,491,017 A | * | 2/1996 | Todt | 428/198 |

FOREIGN PATENT DOCUMENTS

| | | |
|---|---|---|
| GB | 1194706 | 6/1970 |
| JP | 52-27595 | 7/1977 |
| JP | 56 84778 | 7/1981 |
| JP | 60 198239 | 10/1985 |
| JP | 62 85940 | 4/1987 |
| JP | 2 192941 | 7/1990 |
| JP | 4 215924 | 8/1992 |

* cited by examiner

*Primary Examiner*—Ula C. Ruddock
(74) *Attorney, Agent, or Firm*—Harness, Dickey & Pierce, P.L.C.

(57) ABSTRACT

A shrink wrap material for protecting articles includes at least one non-woven fabric and a woven scrim defining apertures. A sufficient portion of the fibers from the non-woven fabric being forced into the apertures of the scrim such that the scrim reinforces and supports the non-woven fabric, thus increasing their strength. A shrinkable, stretchable film is intermittently bonded to at least one non-woven fabric. The material is used by placing the material around the article to be protected and then shrinking the film.

15 Claims, 7 Drawing Sheets

SHRINK WRAP MATERIAL HAVING REINFORCING SCRIM AND METHOD FOR ITS MANUFACTURE

TECHNICAL FIELD

This invention relates to a shrink wrap material for protecting objects during transport and storage which has a reinforcing scrim.

BACKGROUND OF THE INVENTION

Large articles, such as automobiles, machinery and boats must often be transported from the factory to the ultimate consumer on open trucks where they are exposed to the environment. Consumers expect that new automobiles, boats and machinery be in pristine condition and will not tolerate defects. As discussed in prior U.S. Pat. No. 5,491,017, damage may be caused by a number of factors including acid rain and hurled objects, such a small rocks and stones.

The wrap material disclosed in U.S. Pat. No. 5,491,017 includes a non-woven fabric intermittently bonded to a shrinkable and stretchable film that has a predetermined shrink response as heat is applied thereto. However, for some applications, a stronger wrap material is required. U.S. Pat. No. 5,712,008 discloses a wrap material similar to that disclosed in U.S. Pat. No. 5,491,017, except that a woven material is used instead of the non-woven fabric, thereby increasing the strength of the material. The woven material, however is not as soft as the non-woven fabric.

SUMMARY OF THE INVENTION

The present invention provides a multi-layer material that may be shrunk around articles to protect them during transport and storage. The material includes a shrinkable film and a non-woven material reinforced by a reinforcing scrim. Accordingly, due to the reinforcement provided by the scrim, the multi-layer material according to the present invention has increased strength and tear resistance as compared to other known materials, but retains the softness of such material. Accordingly, the multi-layer material of the present invention may be used where a stronger material is desired or required yet has the softness to protect the surface of the article.

DETAILED DESCRIPTION OF THE PREFERRED EMBODIMENT

Figure 1:
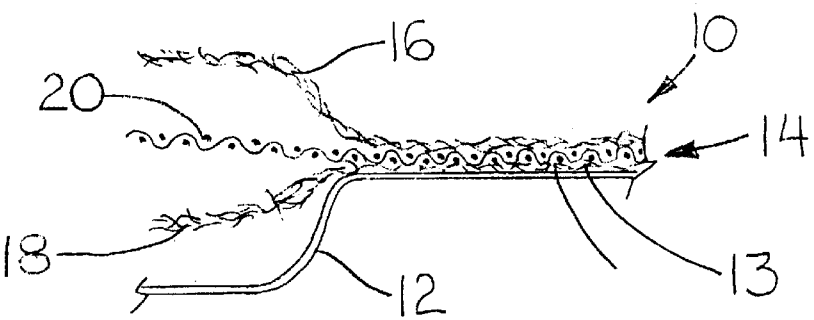
FIG. 1 is a fragmentary cross-sectional view taken through the material of the present invention, with the edge of the material being pulled apart to disclose the various layers of the material.
Figure 2:
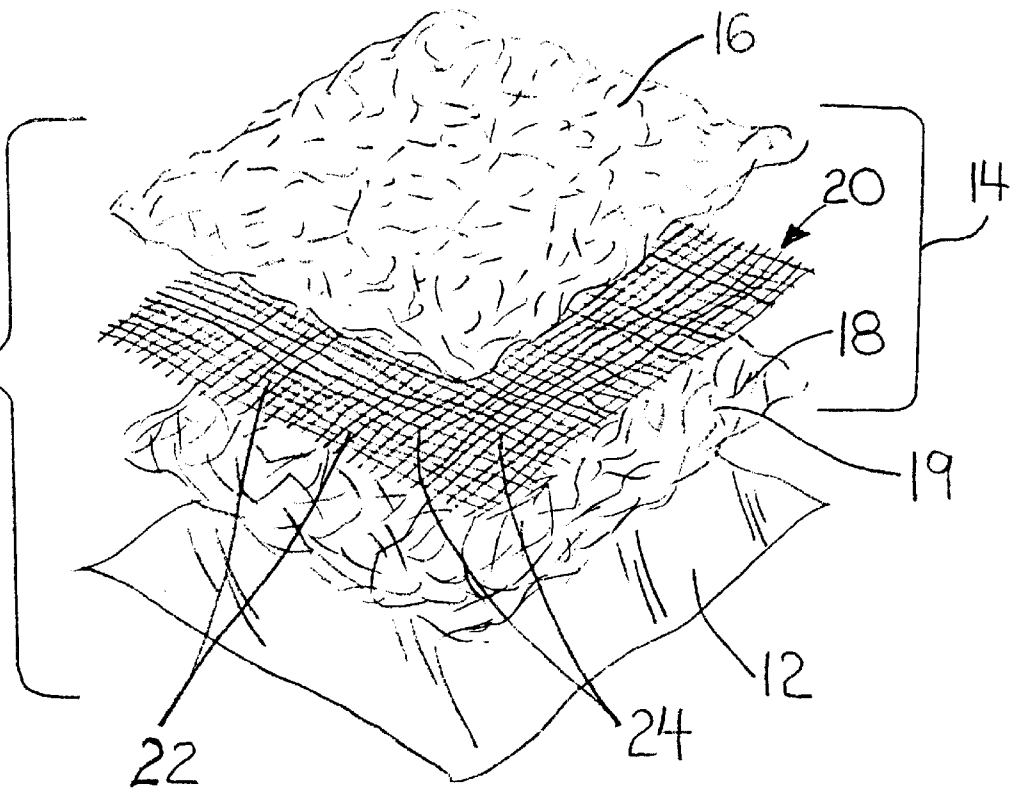
FIG. 2 is an exploded view in perspective illustrating the material of the present invention.

Referring now to FIGS. 1 and 2, the multi-layer material 10 of the present invention includes a first layer 12 of a shrinkable film, preferably a shrinkable, stretchable film, such as a film available from Wright Plastics Corporation, Prattville, Ala. and sold as film TS-5, or a film sold as film C-40 by Crayex Corporation, Piqua, Ohio. The multi-layer material 10 includes a composite layer generally indicated by the numeral 14. The first layer 12 and composite layer 14 are secured to each other by intermittent bonds. As disclosed in the above-mentioned U.S. Pat. No. 5,491,017, the material 10 is used by arranging the material 10 around the article to be protected with the second layer 14 resting on the surface of the article and supporting the film or first layer 12 away from the surface of the article. This may be accomplished by forming the material into a bag (such as by sewing panels of the material 10 together or by joining panels of the material 10 by other appropriate methods, such as by ultrasonic welding or RF sealing) which fits over the article being protected. Heat is then applied to the material to shrink the film. Since the first film layer 12 shrinks and the second layer 14 does not shrink to any appreciable extent, the regions of the second layer 14 between the intermittent bonds separate or release from the film and then gather up to form cushions.

With a continued reference to FIGS. 1 and 2, the second layer 14 includes a first fibrous web 16 and a second fibrous web 18 on opposite sides of a scrim 20. The fibrous webs 16 and 18 may be commercially available non-woven fabrics, such as the hydro-entangled non-woven fabric Sontara® available from DuPont Co., or any other non-woven fabric made from natural or man-made fibers, or combinations thereof, such as polyester, nylon 6,6 or a combination of nylon and polyester fibers. As will be described hereinafter with respect to FIG. 4, the fibrous webs 16 and 18 may be formed by depositing fibers directly on the scrim instead of being first formed into a non-woven fabric. The scrim 20 is generally woven from threads 22 made out of, by way of non-limiting example, PET, PP, or HDPE, having an average diameter of between about 1/64" to about 1/8". The threads 22 are woven into a scrim 20 generally having 3 threads in each direction per square inch (a 3,3 weave) to 10 threads in each direction per square inch (a 10,10 weave) to form apertures 24. As will be discussed hereinafter, the scrim 20 is disposed between the fibrous webs 16,18 which are pressed against the scrim 20 during the manufacturing process to force some of the fibers of each of fibrous the webs 16 and 18 into the apertures 24 of the scrim 20, thereby securing the fibrous webs 16 and 18 to the scrim 20. Accordingly, the scrim 20 supports and reinforces the fibrous webs 16 and 18. The scrim 20 may also be formed from an adhesive thermoplastic or elastomeric material if so desired, such as hot melt or pressure sensitive adhesives, by way of non-limiting example.

As discussed above, the second layer 14 consisting of the fibrous webs 16 and 18, which are supported and reinforced by the scrim 20, are secured to the first layer 12 by intermittent bonds formed between the web 18 and the first layer 12. The intermittent bonds securing the first layer 12 to the web 18 of the second layer 14 are formed by applying an adhesive to the raised portions 19 of the surface of the fibrous web 18, as more fully described in the aforementioned U.S. Pat. No. 5,491,017. Alternatively, the adhesive may be applied in a repeating pattern by a conventional gravure roll to either the surface of the fibrous web 18 or to the first layer 12. The adhesive is preferably a pressure-responsive hot melt adhesive of the block copolymer family such as, but not limited to, S-I-S (styrene-isoprene-styrene), S-E-S (styrene-ethylene-styrene) or similar adhesive. Such adhesives are available from ATO Corp. of Findlay, Ohio and H. B. Fuller Corp. of Minneapolis, Minn.

Figure 8:
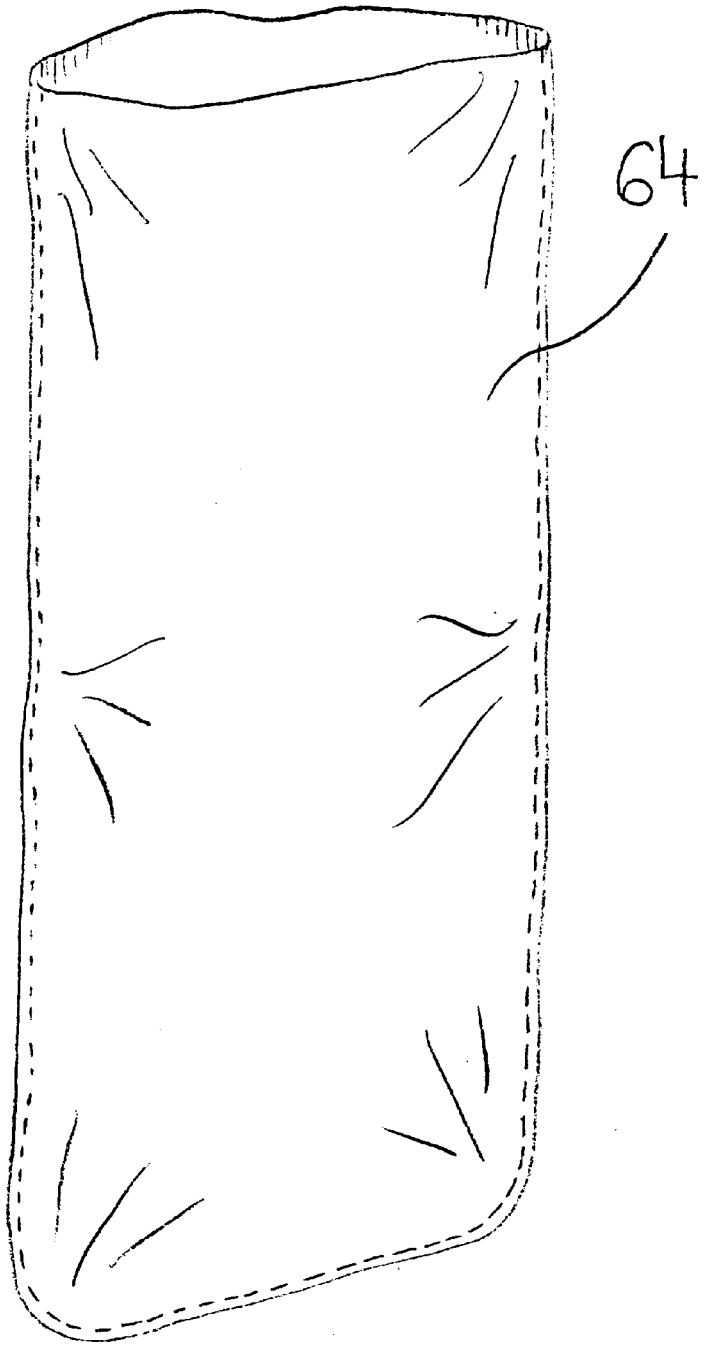
FIG. 8 is a perspective view showing the material of the present invention formed into a protective article.

The presence of the reinforcing scrim 20 increases the strength and tear resistance of the material 10, making it possible to protect articles in environments where the prior art materials did not have sufficient strength. As discussed in U.S. Pat. No. 5,491,017 and illustrated in FIG. 8, the material 10 may be formed into a protective article 64 such as a bag (by cutting the material 10 into panels and joining the panels by sewing, heat sealing or any other appropriate way). By use of the material of the present invention, bags 10 having more complex geometries which would otherwise compromise bag strength, may be used compared to bags made with prior art materials since shrinking the bags of the present material will not easily rupture.

As also disclosed in U.S. Pat. No. 5,491,017, the bag is placed over the object to be protected and then shrunk by applying heat thereto to shrink the film. Accordingly, upon shrinking, the bag closely conforms to the contours of the product such that the scrim 20 is held away from the surface by the non-woven fabric, so that the surface of the article is not damaged while the advantage of the extra strength of the scrim is maintained. After shrinking the film or first layer 12, the scrim 20 substantially adapts to the shape of the surface of the article being protected, but remains elastic after shrinking until the material 10 is removed from the object.

Figure 3:
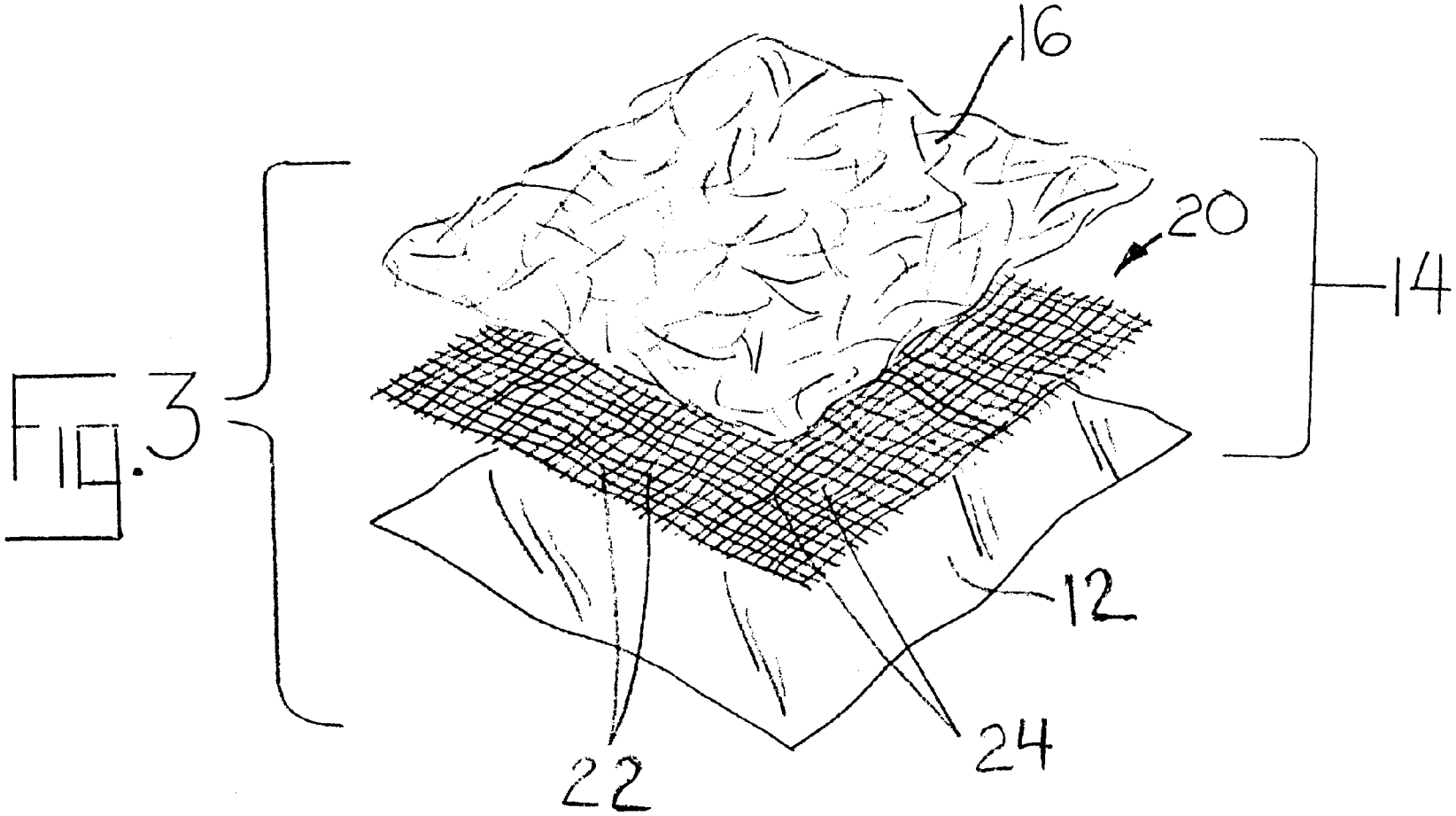
FIG. 3 is an exploded view in perspective illustrating an alternative embodiment of the material of the present invention.

Referring to FIG. 3, there is shown an alternative embodiment of the material 10 which includes a first layer of film 12 and a second layer 14 which includes a fibrous web 16 and a scrim 20. According to this embodiment, the second fibrous web which had been disposed between the film 12 and scrim 20 has been eliminated.

Figure 4:
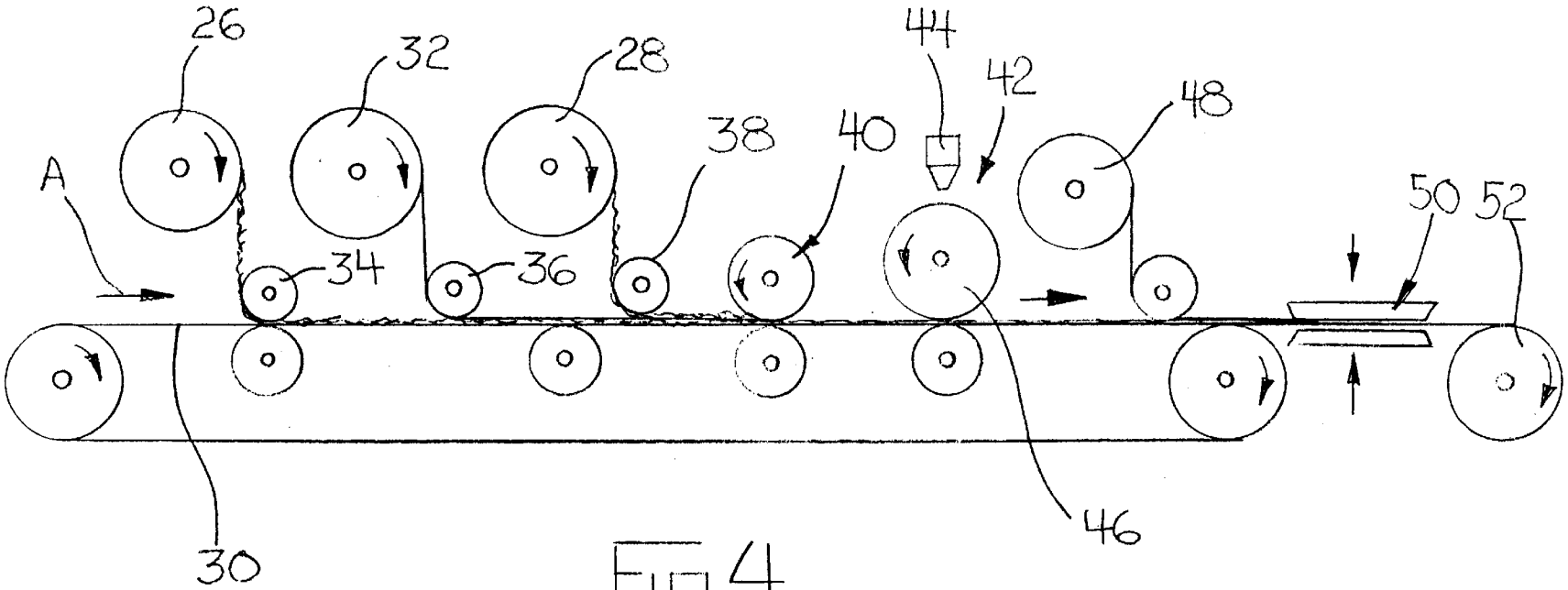
FIG. 4 is a schematic illustration of a preferred method of manufacturing the material shown in FIGS. 1 and 2.

One method of manufacturing the material 10 of the present invention will now be described with reference to FIG. 4. Non-woven fabric is commonly supplied in rolls, such as the rolls 26 and 28 which are supported above an endless conveyor belt generally indicated by the numeral 30. The scrim 20 is also commonly supplied in rolls, such as the roll 32 supported above the conveyor 30 between the rolls 26 and 28 of the non-woven fabric.

Non-woven fabric is pulled from the roll 26 and held against the conveyor belt 30 (which moves in the direction indicated by the arrow A) by roller 34. As the conveyor belt 30 transports the non-woven fabric from roll 26, scrim 20 is pulled from the roll 32 and held against the upper surface of the non-woven fabric from the roll 26 by a roller 36. As the non-woven fabric from roll 26 and the scrim from roll 32 are transported further, non-woven fabric is pulled from the roll 28 and held against the side of the scrim by roller 38.

The conveyor 30 then transports the two layers of non-woven fabric between which the scrim 20 is disposed through a set of compression rollers 40. The compression rollers 40 are adjusted to apply a compression force which presses some of the fibers on the surfaces of the non-woven fabrics into the apertures of the scrim 20 sufficient that the layers of non-woven fabric are integrated with the scrim 20 so that the scrim supports and reinforces the non-woven fabric. It is important that during the laminating/gluing process the low compression forces applied to the non-woven are sufficiently low to effect lamination which does not substantially compress the non-woven fabric to the scrim 20 but rather allows the formation of cushions or raised portions. The material thus formed is then transferred to a gluing station 42, in which adhesive from receptacle 44 is applied via roller 46 to the raised portions of the upper surface of the non-woven fabric on the top of the scrim, such that the adhesive is applied intermittently only on the raised portions of the non-woven fabric as described in U.S. Pat. No. 5,491,017.

The film 12 is pulled from a roll 48 supported over the conveyor belt 30, which transfers the product to a bonding station generally indicated at 50. The bonding station provides a light touching pressure sufficient to cause the adhesive to bond in the areas where the adhesive is been applied and thereby forms the intermittent bonds between the first film layer 12 and the second layer 14 which includes the scrim and the non-woven fabrics. As discussed above, the adhesive is a hot melt, pressure sensitive adhesive that requires only "touching pressure" to bond.

It should be appreciated that instead of applying the adhesive only to the raised portions of the non-woven fabric facing the film, the adhesive may be applied in a repeating pattern to either the film or the non-woven fabric surface by, for example, a contoured gravure roll (not shown) to achieve the intermittent bonding. The material 10 after bonding is then rolled onto a take up roll 52.

Figure 5:
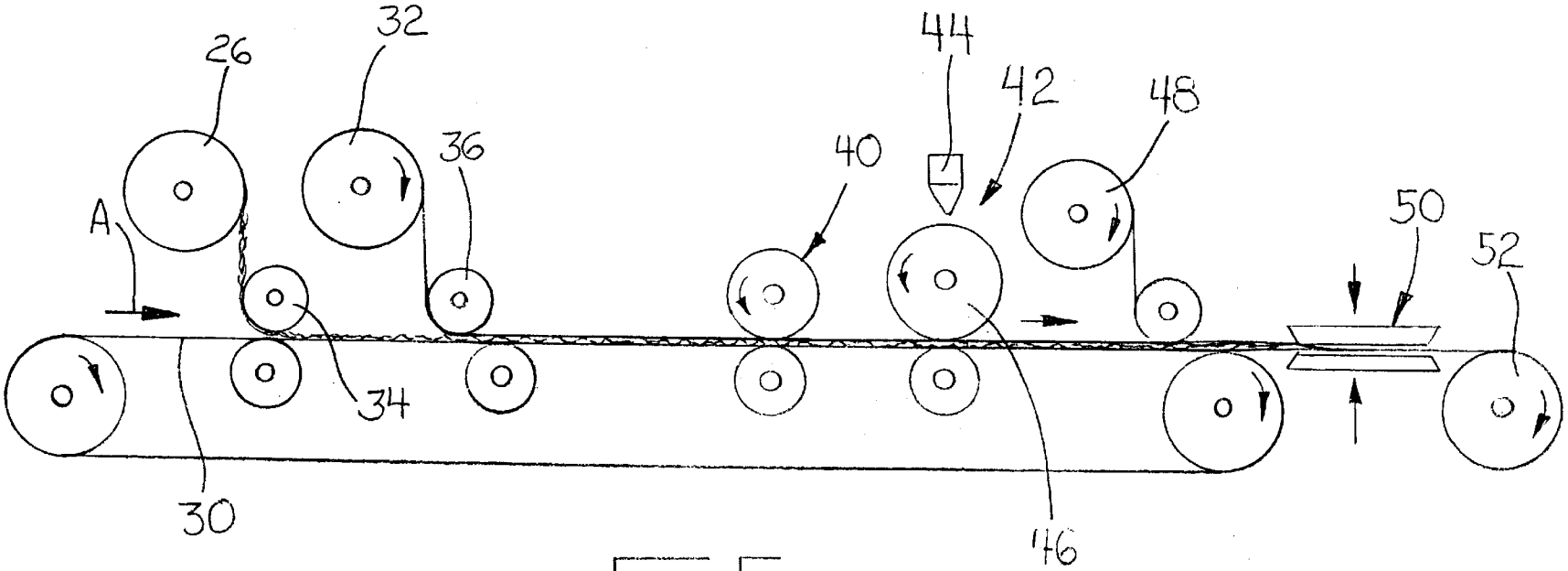
FIG. 5 is a schematic illustration of a preferred method of manufacturing the material shown in FIG. 3.

Referring to FIG. 5, a method of manufacturing the material 10 as illustrated in FIG. 3 will now be described. Again, the non-woven fabric is commonly supplied on a roll, such as roll 26 which is supported above an endless conveyor belt generally indicated by the numeral 30. The scrim 20 is also commonly supplied in rolls, such as the roll 32 supported above the conveyor 30 before roll 26.

Non-woven fabric is pulled from the roll 26 and held against the conveyor belt 30 (which moves in the direction indicated by the arrow A) by roller 34. As the conveyor belt 30 transports the non-woven fabric from roll 26, scrim 20 is pulled from the roll 32 and held against the upper surface of the non-woven fabric from the roll 26 by a roller 36.

The conveyor 30 then transports the layer of non-woven fabric from roll 26 and scrim 20 through a set of compression rollers 40. The compression rollers 40 are adjusted to apply a compression force which presses some of the fibers on the surfaces of the non-woven fabric into the apertures of the scrim 20 sufficient that the layer of non-woven fabric is integrated with the scrim 20 so that the scrim supports and reinforces the non-woven fabric. It is important that during the laminating/gluing process the low compression forces applied to the non-woven are sufficiently low to effect lamination which does not substantially compress the non-woven fabric to the scrim 20 but rather allows the formation of cushions or raised portions. The material thus formed is then transferred to a gluing station 42, in which adhesive from receptacle 44 is applied via roller 46 to the raised portions of the upper surface of the non-woven fabric extending through the scrim, such that the adhesive is applied intermittently only on the raised portions of the non-woven fabric.

The film 12 is pulled from a roll 48 supported over the conveyor belt 30, which transfers the product to a bonding station generally indicated at 50. The bonding station provides a light touching pressure sufficient to cause the adhesive to bond in the areas where the adhesive has been applied and thereby forms the intermittent bonds between the first film layer 12 and the second layer 14 which includes the scrim and the non-woven fabric. As discussed above, the adhesive is preferably a hot melt, pressure sensitive adhesive that requires only "touching pressure" to bond.

It should be appreciated that instead of applying the adhesive only to the raised portions of the non-woven fabric, the adhesive may be applied in a repeating pattern to either the film or the non-woven fabric surface by, for example, a contoured gravure roll (not shown) to achieve the intermittent bonding. The material 10 after bonding is then generally rolled onto a take up roll 52.

Figure 6:
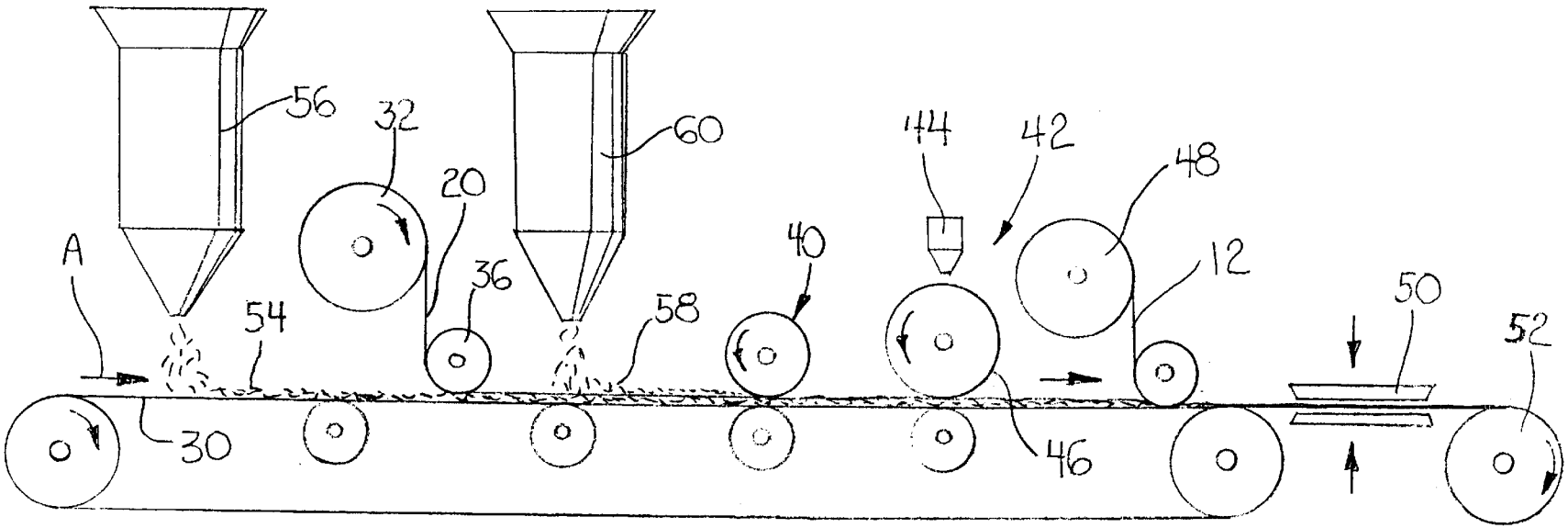
FIG. 6 is a schematic illustration of a second preferred method of manufacturing the material shown in FIGS. 1 and 2.

Referring now to FIG. 6 of the drawings, a second preferred method of manufacturing the material 10 will be described. A first mass of staple fibers generally indicated at 54 (staple fibers are fibers cut to a predetermined length) is deposited uniformly on the conveyor belt 30 from a hopper/carder 56 supported over the conveyor belt 30 and extending across the width of the conveyor belt 30. The fibers may be any of the fibers discussed above, all of which are readily commercially available, or mixtures of fibers. The fibrous mass 54 is then transferred in the direction of the arrow A, and scrim 20 is pulled from the roll 32 and positioned against the fibrous mass 54. A second fibrous mass indicated at 58 is provided onto the scrim 20 from a hopper/carder 60 supported over the conveyor belt 30. The hopper/carder 60 is substantially identical to the hopper/carder 56, and the fibers comprising the fibrous mass 58 may be substantially the same or different from the fibers comprising the fibrous mass 54. The fibers stored within the hopper/carders 56, 60 are preferably mixed with a powder adhesive to bind the fibers into a mat after being deposited on the conveyor belt 30.

The conveyor belt 30 then transports the fibrous mass 54 and the scrim 20 through a set of compression rollers 40. The compression rollers 40 are set to sufficiently compact the fibrous mass 54 to force the fibers to entangle with one another and to force some of the fibers into the apertures defined by the scrim 20. Accordingly, the scrim 20 supports and reinforces the fibers of the fibrous mass 54 which have been sufficiently compressed to form a web of non-woven fabric. As discussed above, the film 12 is intermittently bonded to the fibers, and the completed wrap material 10 may then rolled on the take up roll 52 and stored for use.

Figure 7:
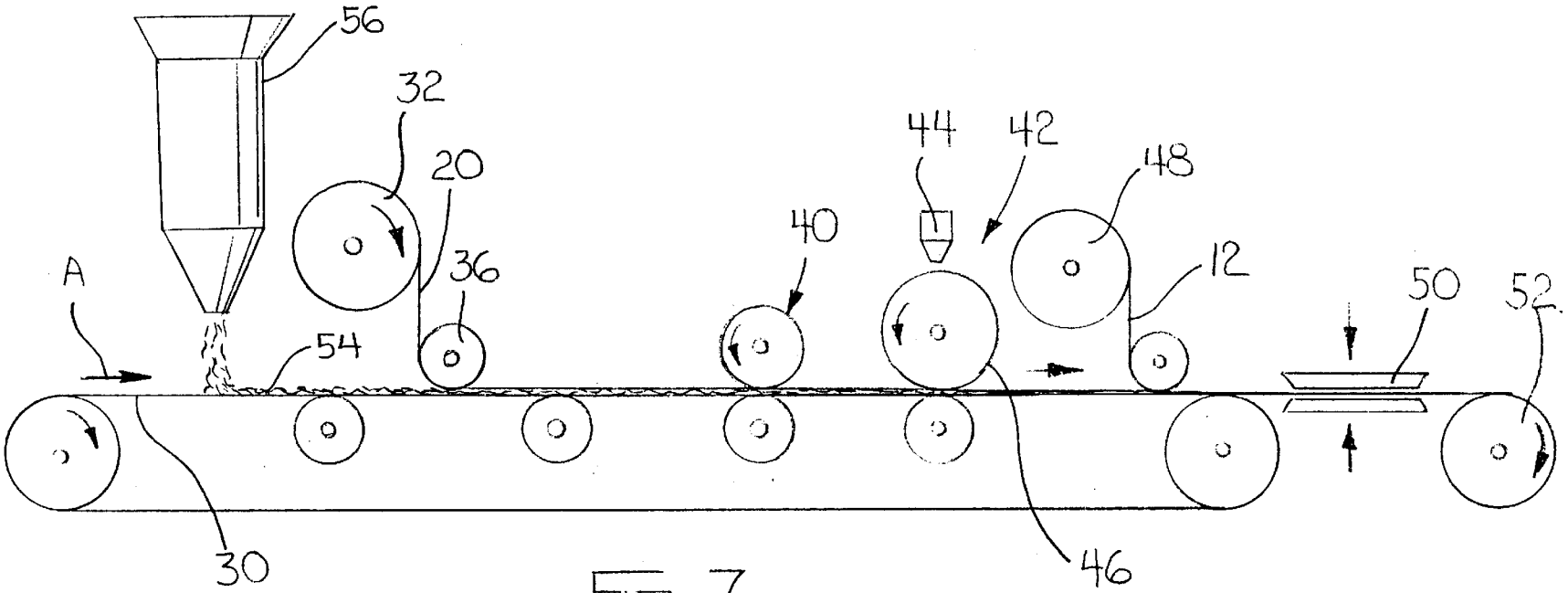
FIG. 7 is a schematic illustration of a second preferred method of manufacturing the material shown in FIG. 3.

Referring to FIG. 7, yet another method of manufacturing the material 10 of the present invention will now be described. A first mass of staple fibers generally indicated at 54 (staple fibers are fibers cut to a predetermined length) is deposited uniformly on the conveyor belt 30 from a hopper/carder 56 supported over the conveyor belt 30 and extending across the width of the conveyor belt 30. The fibrous mass 54 is then transferred in the direction of the arrow A, and scrim 20 is pulled from the roll 32 and positioned against the fibrous mass 54. The fibers stored within the hopper 56 are preferably mixed with a powder adhesive to bind the fibers into a mat after being deposited on the conveyor belt 30. The conveyor belt 30 then transports the fibrous masses 54, 58 and the scrim 20 through a set of compression rollers 40. The compression rollers 40 are set to sufficiently compact the fibrous masses 54, 58 to force the fibers to entangle with one another and form a unitary fibrous structure, and also to force some of the fibers from each of the fibrous masses 54, 58 into the apertures defined by the scrim 20 and thus form a unitary fibrous structure. Accordingly, the scrim 20 supports and reinforces the fibers of the fibrous mass 54 and 58, which have had their fibers sufficiently entangled by the compression rollers 40 to form a web or non-woven fabric. As discussed above, the film 12 is intermittently boned to the fibers, and the completed wrap material 10 may then rolled on the take up roll 52 and stored for use.

While it will be apparent that the preferred embodiments of the invention disclosed are well calculated to fulfill the objects stated, it will be appreciated that the invention is susceptible to modification, variation and change without departing from the spirit thereof.

What is claimed is:

1. Material for protecting articles comprising a heat shrinkable film first layer having a predetermined shrink response in response to heat applied thereto, and a composite second layer including a flexible scrim defining apertures and, first and second webs of fiber disposed on opposite sides of said flexible scrim such that said webs of fiber are entangled through the apertures of said scrim, said scrim remaining elastic after said material is heat shrunk, said second layer being secured to said film first layer via intermittent bonds.

2. Material as claimed in claim 1, wherein said webs of fiber are in the form of non-woven fabrics.

3. Material as claimed in claim 2, wherein said fibers of said non-woven fabrics are pressed into the apertures of the scrim.

4. Material as claimed in claim 1, wherein said, webs of fiber are hydro-entangled with said scrim, wherein said scrim supports said fibers and resists pulling of said fibers away from one another.

5. Material as claimed in claim 1, wherein multiple pieces of the material for protecting articles are joined together to form a protective article.

6. Material as claimed in claim 1 wherein said intermittent bonds occurring between the first and second layers are adhesive bonds.

7. Material as claimed in claim 6 wherein said adhesive bonds are hot melt adhesive bonds.

8. Material as claimed in claim 1 wherein said first web of fibers include raised portions to which an adhesive is applied to form the intermittent bonds with said first film layer.

9. Material for protecting the surface of articles against damage comprising a shrinkable film first layer and a second composite layer including;

a) a first fibrous web which is intermittently bonded to said film first layer;

b) an elastic scrim including apertures, said scrim being disposed along said first fibrous web opposite said film first layer; and c) a second fibrous web disposed along said elastic scrim opposite said first fibrous web, wherein said first and second fibrous webs are entangled with said scrim through said apertures.

10. Material as claimed in claim 9, wherein said shrinkable film first layer has a predetermined shrink response in response to heat applied thereto.

11. Material as claimed in claim 9, wherein said fibrous webs are in the form of non-woven fabrics.

12. Material as claimed in claim 9, wherein said webs of fiber are hydro-entangled with said scrim, wherein said scrim supports said fibers and resists pulling of said fibers away from one another.

13. Material as claimed in claim 9, wherein said intermittent bonds occurring between the first and second layers as adhesive bonds.

14. Material as claimed in claim 9, wherein said adhesive bonds are hot melt adhesive bonds.

15. Material as claimed in claim 9, wherein said first web of fibers include raised portions to which adhesive is applied to form the intermittent bonds with said first layer.

* * * * *